United States Patent [19]

Shim

[11] Patent Number: 4,711,458

[45] Date of Patent: Dec. 8, 1987

[54] ROLLER SKATE

[76] Inventor: Hyun J. Shim, 350-39, Sangdo 3-dong, Dongjak-Ku, Seoul, Rep. of Korea

[21] Appl. No.: 785,946

[22] Filed: Oct. 9, 1985

[30] Foreign Application Priority Data

Jul. 12, 1985 [KR] Rep. of Korea ..... 8789/1985[U]

[51] Int. Cl.[4] ..... A63C 17/04

[52] U.S. Cl. ..... 280/11.22; 280/11.27

[58] Field of Search ..... 280/11.19, 11.22, 11.23, 280/11.27, 11.1 BT, 13, 14, 7.13

[56] References Cited

U.S. PATENT DOCUMENTS 3,501,162 3/1970 Toone ..... 280/11.23

3,963,252 6/1976 Carlson ..... 280/11.22

4,108,450 8/1976 Cote ..... 280/11.22

FOREIGN PATENT DOCUMENTS 246600 11/1960 Australia ..... 280/11.22

1218851 5/1960 France ..... 280/11.22

*Primary Examiner*—John J. Love

*Assistant Examiner*—Richard M. Camby

*Attorney, Agent, or Firm*—Townsend and Townsend

[57] ABSTRACT

This invention pertains to a roller skate with a bottom plate for supporting a shoe. The skate has two upper frames extending in the longitudinal direction under the bottom plate. The upper frames are parallel to each other and each house three bearing boxes that carry clamping pads for mounting three roller shafts.

7 Claims, 4 Drawing Figures

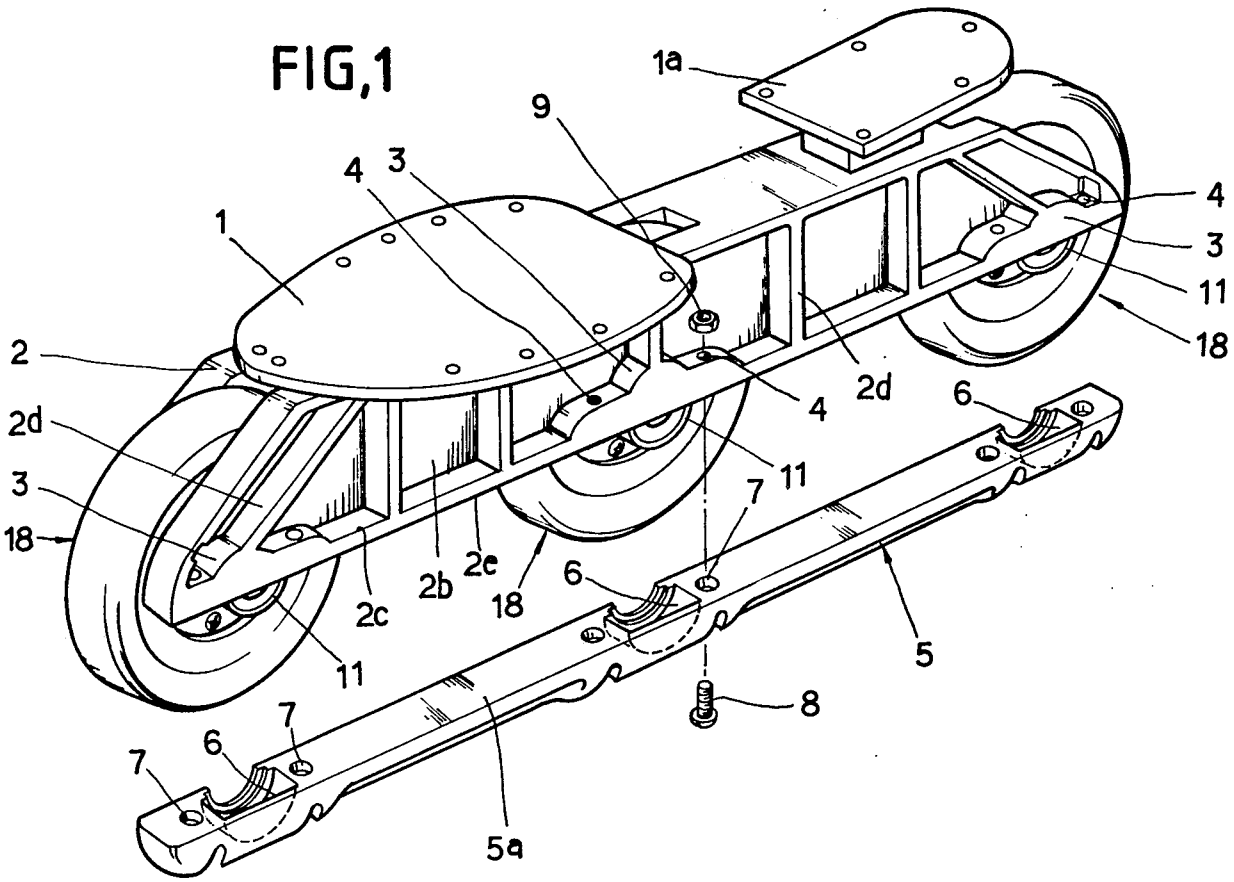
FIG,1

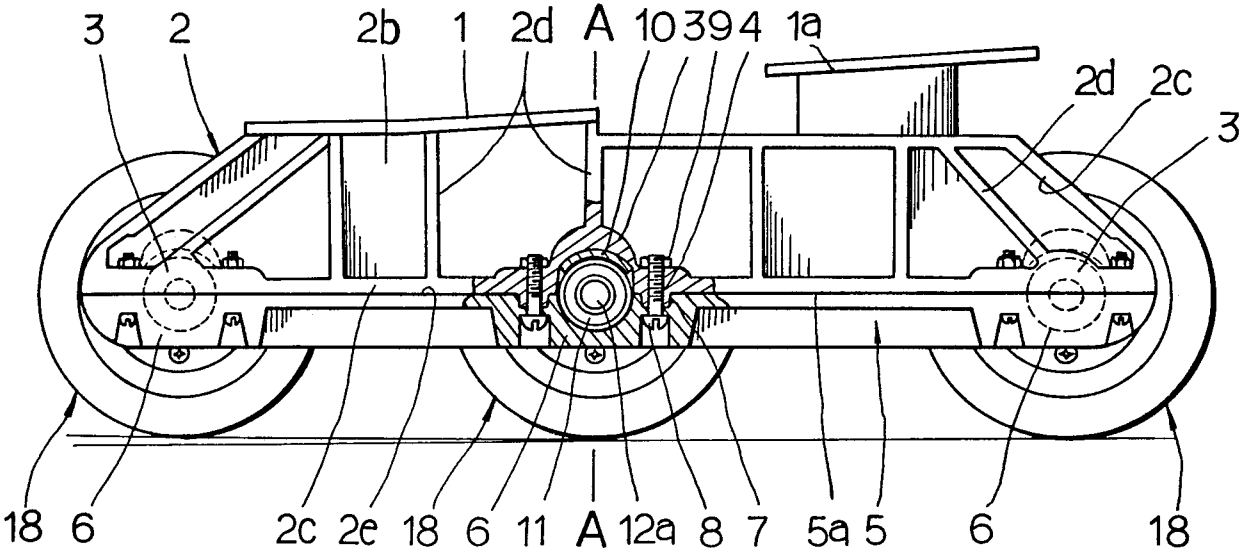
FIG,2

FIG,4
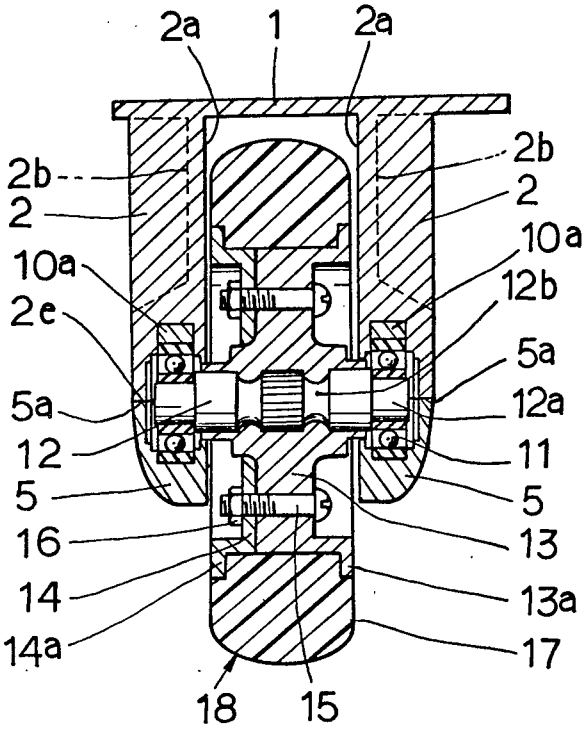
FIG,3
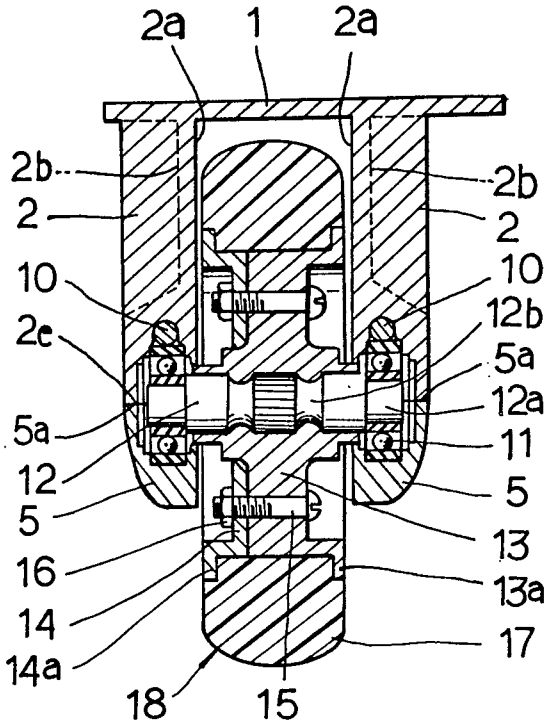

ROLLER SKATE

BACKGROUND OF THE INVENTION

The present invention relates to a roller skate, and particularly a three wheel-driving roller skate in which three rollers are arranged in a line.

Heretofore, various constructions of roller skates have been known. Most of such conventional roller skates have the construction wherein bearings are displaced at the front and rear of bottom plate of a skate shoe, respectively, and two pairs of rollers are rotatably mounted on respective roller shaft journalled to said bearings. As a skater changes the skating direction or sharply turns during skating, rollers are laterally inclined, thereby causing them to contact with side surfaces of bearing plates or said bearing plates and ends of roller shafts to contact with a ground. Due to such contact, severe friction occurs, which results in adversely reducing the skating speed. In the above-mentioned construction of skate, it is also difficult to provide an easy conversion of the skating direction, because the roller surface contacting with the ground is wide. Where the ground is not level, the skater is subject to severe vibration and impact, because the roller has not a cushion. This causes a harmful side effects of the body of skater. All forward and rearward rollers are disposed vertically below the bottom plate of skate shoe. Where the roller has a large diameter, accordingly, the stability of skating is lost. As a result, it is needed to use a roller of small diameter. Since this is a factor of limiting a skating speed, however, the skater can not feel, during skating, a lightness and comfortness as felt in an ice-skating.

SUMMARY OF THE INVENTION

Accordingly, an object of the present invention is to provide an improved roller skate which eliminates the problems of the prior art described above so that a skater can do skating at a speed close to that of ice-skating and in a similar manner to that of ice-skating.

The other object of the present invention is to provide a roller skate in which a relatively narrow rollers having large diameters are arranged in a line to provide a reduced contact area of said rollers, and thus, a reduced frictional resistance; so that the speed of skating can be increased; so that a skater can easily convert the direction of skating; and so that the speed of skating is not reduced even in a sharp turning.

Another object of the present invention is to provide a roller skate in which a damping means of very simple construction easily absorbs an impact which is forced on rollers during a skating, so that a skater can feel a lightness and comfortness as felt in an ice-skating.

Still another object of the present invention is to provide a roller skate which is stable in the construction and able to be easily manufactured and to be easily assembled and disassembled.

In accordance with the present invention, these objects are accomplished by providing a roller skate comprising a bottom plate supporting a shoe thereon; a pair of upper frames extended longitudinally in parallel with each other on the lower surface of said bottom plate and formed integrally with said bottom plate, each upper frame having a length longer than that of said bottom plate and three semi-circular bearing boxes disposed at front end, rear end, and middle portions thereof; a pair of lower frames attached to respective lower portions of said upper frames by means of bolts and nuts, each lower frame having an upper surface corresponding to the lower surface of each upper frame and three semi-circular bearing boxes corresponding to respective bearing boxes of each upper frame; three bearings disposed within respective corresponding bearing boxes of each upper frame and each lower frame, each bearing carrying a damping pad at the upper portion thereof; and, three rollers arranged in a line between said upper and lower frames, each roller having a shaft formed integrally therewith, both ends of said shaft being journalled on said corresponding bearings, respectively.

According to the present invention, the damping pad is made of an elastic material such as a rubber or urethan resin. The bottom plate and both upper frames are integrally formed by using an injection molding process of synthetic resin. Each upper frame has a flat inner surface and an outer surface provided with a plurality of reinforcing ribs at peripheral edge and at the middle portion thereof. By the provision of said reinforcing ribs, it is possible to provide the upper frame having a light weight resulted from saving the material used and a constructional strength.

Each lower frame is also made of identical synthetic resin to that of the upper frame. The lower frame has a flat inner surface and an outer surface which is inwardly tapered, as extended downwardly, to form an arc surface at the lower end thereof. Accordingly, the lower frame does not contact with the ground, when rollers are inclined during a skating.

According to the present invention, each roller has a roller shaft formed integrally therewith. For example, a synthetic resin boss having a proper diameter is formed integrally with and around a metal shaft provided with annular recesses or teeth. A rubber wheel, which is made to the material having a high anti-wearness such as a silicon rubber, is fitted around said boss. Then, the rubber wheel is fixedly held to said boss by disposing an annular holding plate at one side surface of said rubber wheel and fixing said plate to said boss by means of bolts and nuts. By this arrangement, when a certain rubber wheel wears, it is possible to replace only it into a new one, without any necessity of the replacement of roller.

Other objects and features will be apparent, by referring to the following description expressed in reference with the drawings.

BRIEF DESCRIPTION OF THE DRAWINGS

FIG. 1 is a partially exploded-perspective view of a roller skate according to an embodiment of the present invention;

FIG. 2 is a partially cut away-side view of a roller skate shown in FIG. 1;

FIG. 3 is a cross-sectional view taken along the line A—A of FIG. 2; and FIG. 4 is a cross-sectional view similar to FIG. 3, showing another embodiment of present invention.

DETAILED DESCRIPTION OF THE INVENTION

FIG. 1 to FIG. 3 show a roller skate construction in accordance with an embodiment of the present invention. In the drawings, reference numerals 1 and 1*a* designates bottom plates of a skate shoe not shown, which are plate-type members fixed to the bottom surface of skate shoe by means of a connecting member such as a bolt. Although said bottom plates 1 and 1*a* are shown as separated from each other in the drawings, they may be formed into an integral member.

At the lower surface of said bottom plates 1 and 1*a*, a pair of roller-supporting upper frames 2 are formed integrally with said bottom plates to protrude downwardly from said bottom plates. Upper frames 2 extends longitudinally in parallel with each other to have a length longer than that of said bottom plates.

Each upper frame 2 has a relatively trapezoidal shape which has a vertically flat inner surface 2*a* and an outer surface 2*b* provided with reinforcing ribs 2*c* and 2*d* at peripheral edge and at the middle portion thereof, respectively. Ribs 2*c* and 2*d* have suitable widths and thicknesses and provide a desired strength to the frame 2.

On the lower surface 2*a* of each upper frame 2, three bearing boxes 3 are formed at front end, rear end, and middle portions of said upper frame 2. As shown most clearly in FIG. 2, bearing boxes 3 may be, and preferably, are, placed, along the length of upper frames 2, forward of plate 1 (and hence the skater's toe), near the center of upper frames 2, and rearward of plate 1*a* (and hence the skater's heel), respectively. Each bearing box 3 has a pair of bolt holes 4 at both side thereof, respectively.

At the lower surface 2*e* of each upper frame 2, a lower frame 5 is attached to said upper frame 2 by means of a plurality of bolts 8 and nuts 9, each of which bolt is inserted into a bolt hole 4 and 7 formed at said upper and lower frames, respectively. Each lower frame 5 has an upper surface 5*a* corresponding to said lower surface 2*e* of the upper frame 2 and three semi-circular bearing boxes 6 corresponding to respective bearing boxes 3 of said upper frame 2.

Within each of corresponding bearing boxes 3 and 6 of each upper frame 2 and each lower frame 5, a bearing 11 is received as shown in FIG. 2 and FIG. 3. Between the upper portion of each bearing 11 and the corresponding inner surface portion of bearing box 3, a circular damping pad 10 made of an elastic material such as a rubber or urethan resin. Preferably, as shown in FIG. 2, damping pad 10 is formed to extend in an arc between bearing 11 and bearing box 3.

Three rollers 18 are arranged in a line between said upper and lower frames 2 and 5. Each roller 18 has a metal roller shaft 12 formed integrally therewith. Both ends of each shaft 12 are journalled on the corresponding bearings 11 receiving within the gearing boxes 3 and 6 of each upper frame 2 and each lower frame 5, respectively. As shown in FIG. 3, the roller shaft 12 is provided with annular recesses 12*b* at the periphery thereof. Around the roller shaft 12, a synthetic resin boss 13 is formed integrally to be unitary or fixedly mounted with said roller shaft 12 by using a injection molding process. The boss 13 has an annular rim 13*a* at one said edge. At the other side of said boss 13, an annular holding plate 14 having an annular rim 14*a* is fixed to said boss 13, by means of bolts 15 and nuts 16. Around said boss 13, a rubber wheel 17 is fitted, which is made of the material having a high anti-wearness. The rubber wheel 17 is fixedly held on said boss 13 by means of said holding plate 14.

FIG. 4 shows a variant embodiment of present invention wherein a square or rectangular damping pad 10*a* is used.

In accordance with the present invention mentioned above, three rollers 18 are arranged in a line and supported at both ends of respective roller shafts 12 thereof, by a pair of upper frames 2 extended longitudinally in parallel with each other on respective lower surfaces of bottom plates 1 and 1*a* and beyond the length of said bottom plates, and a pair of lower frames 5 separately attached to respective upper frames. By this arrangement, the roller 18 is able to have an increased diameter, while maintaining the width thereof to be minimum. This enables to reduce the frictional resistance of roller skate to the ground, thereby caused the skating speed to be greatly increased. And also, a conversion of the skating direction and a sharp turning is easily carried out during a skating.

In each roller 18, the roller shaft 12 and the boss 13 are formed into an integral part. And also, both ends 12 of each roller shaft 12 are journalled to the corresponding bearing 11 received within the corresponding bearing boxes 3 and 6 of each upper frame 2 and each lower frame 5. By this arrangement, there are no problems that the boss is subject to a heavy load and that the peripheral edge of roller 18 contacts with inner side surfaces of frames and thus generates a friction, even when the roller is subject to a lateral pressure or impact during skilling, due to a lateral inclination of the roller with respect to the ground. Accordingly, the roller can be rotated smoothly.

By a damping pad disposed between upper surface of each bearing and the lower surface of the corresponding bearing box of upper frame, an impact forced to the roller shaft 12 is effectively absorbed. As a result, a skater can feel a lightness and comfortness as felt in an ice-skating, without a feeling of unpleasant vibration and impact.

Due to reinforcing ribs 2*c* and 2*d* formed at the outer surface of each upper frame 2, the upper frame 2 has a light weight, while maintaining a desired constructional strength. In view of the fact that the lower frame 5 can be easily assembled with and disassembled from the upper frame 2, the replacement and maintenance of roller 18 can is simply and easily carried out. And also, the lower frame 5 functions as a tensioning means against a vertical load, enabling a skater to maintain more stable and firmness skating position.

What is claimed is:

1. A roller skate comprising:

a bottom plate for supporting a shoe thereon;

a pair of upper frames extending longitudinally in parallel with each other on the lower surface of said bottom plate and formed integrally with said bottom plate, each upper frame having a length longer than that of said bottom plate and three semi-circular bearing boxes disposed at the front end, rear end, and middle portions thereof;

a pair of lower frames extending along substantially the length of said corresponding upper frames attached to respective lower portions of said upper frames by means of bolts and nuts, each lower frame having an upper surface corresponding to the lower surface of each upper frame and three semi-circular bearing boxes corresponding to respective bearing boxes of each upper frame;

three bearings disposed within corresponding bearing boxes of each upper frame and each lower frame, each bearing carrying a damping pad along the upper portion thereof; and three rollers arranged in a line between said upper and lower frames, each roller having a shaft formed to be unitary therewith, both ends of said 2. The roller skate according to claim 1, wherein each roller comprises a boss formed to be unitary with and around the roller shaft, a holding plate attached to one side surface of said boss by means of bolt-connection, and a rubber wheel fitted around said boss and held firmly in place on said boss by means of said holding plate.

3. The roller skate according to claim 1 wherein each of said upper frames has one of said bearing boxes disposed in front of the shoe and one of said bearing boxes disposed to the rear of the shoe, and the third of said bearing boxes disposed below a middle portion of the shoe.

4. The roller skate according to claim 1 wherein each damping pad is formed to extend in an arc between the corresponding bearing and bearing box of the upper frame.

5. A roller skate with three rollers in alignment having a bottom plate adapted to be fixed to the front and rear portions of a shoe sole, roller shafts having both ends thereof journaled in corresponding bearings, characterized in that:

a pair of upper frames having lower surfaces extend longitudinally in parallel to each other below said bottom plate and are formed integrally with said bottom plate, each said upper frame having lower and upper parts, each lower part being longer than the corresponding upper part and having semicircular bearing boxes at the front, middle, and rear portions of the lower part, a pair of lower frames are located below said upper frames, said lower frames having upper surfaces corresponding to said lower surfaces, each said lower frame having semi-circular lower bearing boxes at positions corresponding to those of said upper bearing boxes, said bearings are received in and between said upper and lower bearing boxes.

said upper and lower frames are bolted to each other by means of bolts and nuts, each of said bearings carries a damping pad along its upper surface, and each of said upper bearing boxes is provided with a recess therein for receiving said damping pad carried by the corresponding bearing.

6. The roller skate of claim 3, wherein each said roller comprises a boss having an annular rim engaged fixedly with said roller shaft, a rubber wheel placed around said boss, and an annular holding plate pposing said annular rim and bolted to said boss to hold said rubber wheel firmly in place on said boss.

7. The roller skate of claim 1 wherein one of said rollers is positioned forward of said plate, and one of said rollers is positioned rearward of said plate.

* * * * *